United States Patent [19]

Hartley

[11] Patent Number: 4,625,832

[45] Date of Patent: Dec. 2, 1986

[54] LADDER SUPPORT MEMBER

[76] Inventor: D. Wayne Hartley, 1429 Mosstree Rd., N. Charleston, S.C. 29406

[21] Appl. No.: 796,751

[22] Filed: Nov. 12, 1985

[51] Int. Cl.[4] ..... E06C 1/20

[52] U.S. Cl. ..... 182/172; 182/204

[58] Field of Search ..... 182/172, 169, 170, 177

[56] References Cited

U.S. PATENT DOCUMENTS

| | | | |
|---|---|---|---|
| 1,496,201 | 6/1924 | Baxter | 182/172 |
| 3,568,798 | 3/1971 | Pierce | 182/172 |
| 3,878,917 | 4/1975 | McBride | 182/172 |
| 3,901,354 | 8/1975 | Grebausky | 182/172 |
| 4,175,641 | 11/1979 | Reyes | 182/172 |

*Primary Examiner*—Ramon S. Britts
*Assistant Examiner*—Karen J. Chotkowski
*Attorney, Agent, or Firm*—B. Craig Killough

[57] ABSTRACT

An ancillary ladder support or leg is disclosed which may be attached to ladders of various types (including wood, metal, or fiberglass) and configurations to provide additional support and stability for the ladder. The device uses the leg member of the device to engage a fastener so as to allow attachment, removal and repositioning of the device relative to the ladder without the use of additional tools.

8 Claims, 6 Drawing Figures

LADDER SUPPORT MEMBER

BACKGROUND AND SUMMARY OF THE INVENTION

This invention is in the nature of an ancillary ladder support member or leg which may be attached to a ladder to provide additional stability or support.

The utility of the present invention is in the nature of providing additional support for ladders of virtually every type and configuration. It is anticipated that the ancillary support member disclosed herein will be used primarily: (1) where the nature of the ladder is such that additional support is needed; (2) where a ladder of any type is used on unlevel ground or used at a height such that additional support is desirable or necessary; or (3) where, due to height, the user is made more comfortable in using the ladder by the additional support.

The present invention supplies an ancillary support member which may be easily attached to and removed from virtually any type of ladder, without additional tools. The support member is attached to an existing leg or other member of the ladder, and secured or tightened into place by rotating the leg of the ancillary support member so as to attach and remove the device from the ladder. The invention incorporates a feature so as to allow the device to be used with virtually any type or style of ladder, whether the cross-section of the portion of the ladder to which the device is attached is rectangular, such as is commonly the case with wooden ladders, or is in the shape of a channel, which is commonly the case with aluminum ladders.

Briefly, the device comprises a member which is attached to a ladder by means of a threaded fastener. The threaded fastener is engaged and disengaged by rotation of the leg itself or directly by hand, which is pivotally attached so as to allow the leg to engage the head of the fastener for rotation.

DETAILED DESCRIPTION OF THE DRAWINGS

DETAILED DESCRIPTION OF THE PREFERRED EMBODIMENT

This invention has a U-shaped bracket which is placed over a portion of the ladder, such as an existing leg of the ladder, for attachment of the invention to the ladder. One parallel side of the U-shaped bracket has a threaded void into which a threaded member or screw is placed. A leg member is pivotally attached to the same side of the U-shaped bracket. The upper end of the leg, which is pivotally attached to the U-shaped bracket, has a tooth or teeth therein which will engage with gear teeth on the head of the theaded member. Defined in the most elementary manner, the U-shaped bracket is then placed over a portion of the ladder, such as a leg of the ladder, and the leg of the device is lifted so as to engage the tooth of the leg with the teeth on the screw, and the leg is then be rotated so as to tighten the screw against the ladder and hold the device firmly in place. The device is removed by rotation of the leg in the opposite direction so as to retract the screw from the ladder.

Figure 1:
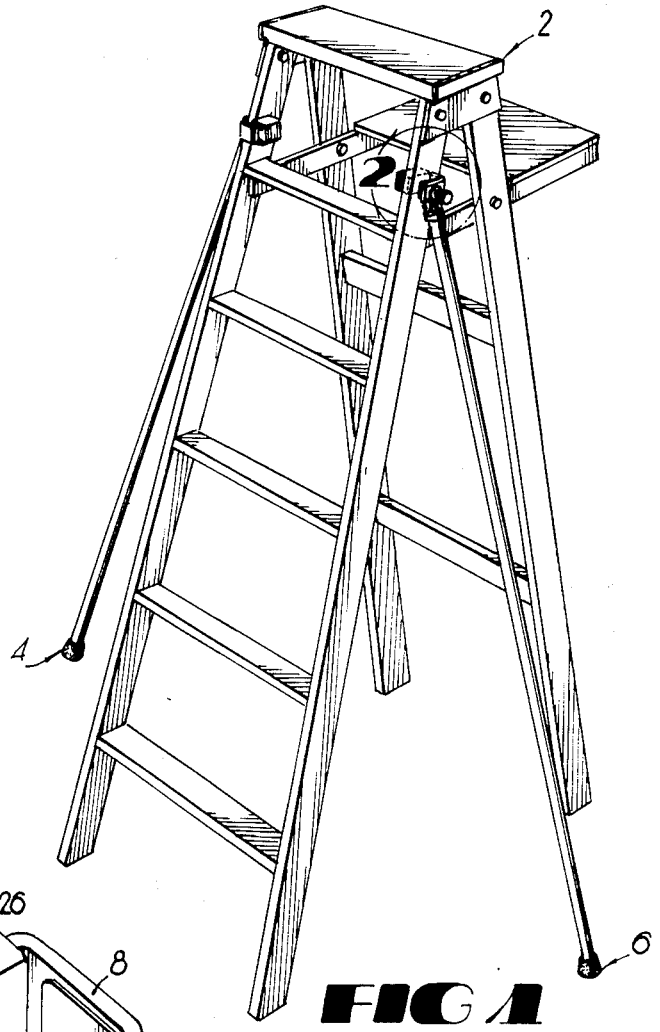
FIG. 1 is a perspective view of a wooden stepladder, having an ancillary support member attached to each side thereof.

Referring now to the drawings, FIG. 1 shows a stepladder 2, which may be a wooden ladder, to which two of the devices 4,6 have been affixed. The devices 4,6 are attached to a leg of the stepladder 2, and are attached near the top of the stepladder so as to provide optimal stability to the ladder.

Figure 2:
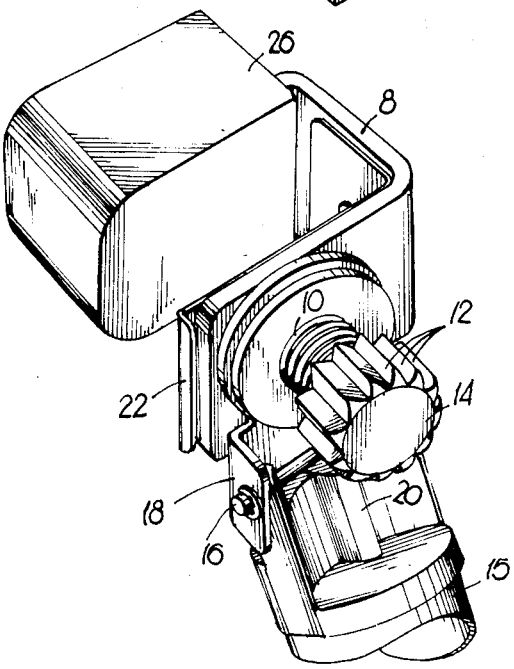
FIG. 2 is an enlarged isolation of the ladder support member taken essentially along line 2—2 of FIG. 1.

FIG. 2 then shows the U-shaped bracket 8 which attaches to the ladder, along with the screw 10 having gear teeth 12 in the head 14 thereof, the pivotal attachment of the leg 15 to the U-shaped bracket 8 by means of a pin 16 running through a bracket 18 on the U-shaped bracket 8 and through the upper portion of the leg 15, and tooth 20 on leg 15 which engages with gear teeth 12 on the screw 10. FIG. 2 further shows a leaf 22 which is attached to the interior portion of the U-shaped bracket 8. This leaf member 22 provides superior clamping force over the screw 10 alone without indenting or damaging the ladder. As the screw 10 is rotated so as to displace it into the interior of the U-shaped bracket 8, it contacts the leaf 22, and displaces the leaf 22 into the ladder 2, providing clamping force. The leaf 22 is allowed to be displaced by being attached to the U-shaped bracket 8 only at one end of the bottom 24 of the "U", while being otherwise unattached to the U-shaped bracket 8. On the parallel side of the U-shaped bracket opposite the screw is a spacing block 26. The spacing block will be more fully described hereinafter.

The most important feature of the invention is the interaction between the leg 15 and the screw 10 which allows the leg to be attached to the ladder firmly and securely, without tools, and which may be operated by virtually anyone due to the great mechanical advantage supplied by the length of the leg. In the preferred embodiment, the interaction between the leg and the threaded member is a gear interaction which is used to displace the screw by threaded means.

Figure 3:
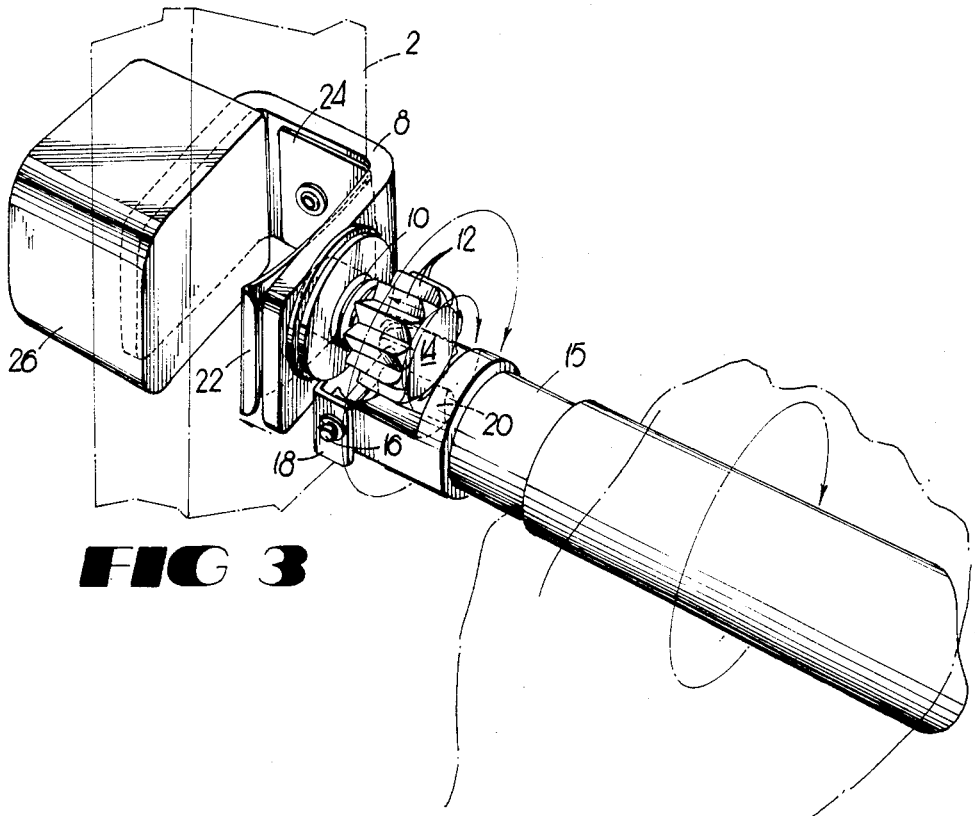
FIG. 3 is a fragmentary, action view of the ladder support means, showing as a phantom the ladder, and the manual rotation of the leg of the support member.

The particular gear interaction and operation of the device is shown in detail in FIG. 3. To engage the gear tooth 20 with the gear teeth 12 on the screw 10, the leg 15 is lifted so that it is substantially in line with the screw. Upon engaging the gear teeth, the leg is then rotated either clockwise or counterclockwise to displace or retract the screw 10, and accordingly cause the U-shaped bracket 8 to be clamped against the leg 2 or other portion of the ladder, holding the device securely in place. The number of gear teeth and the pitch of the teeth should be such that engagement is easily accomplished. It is not critical that there be a fine mesh between the gear teeth, and accordingly, teeth which are rather large and well spaced are preferred. It should further be noted that the interaction between the leg and the threaded member need not be gear interaction, but could be, for example, a frictional engagement. A handle or grip could be placed on the leg to aid in rotating the leg, although in common use sufficient torque may be applied without such a handle or grip.

As indicated, the device is generally attached to the frame of the ladder. The cross-section of wooden ladders is typically rectangular, while metal ladders typically use channel in their construction. The structural components of the ladders will also be of different dimensions. So as to provide a device which can be used almost universally with any ladder, a spacing block 26 is incorporated which is attached to the device on the parallel side opposite the side which incorporates the threaded member. The spacing block 26 is shown in detail in FIG. 4.

Figure 4:
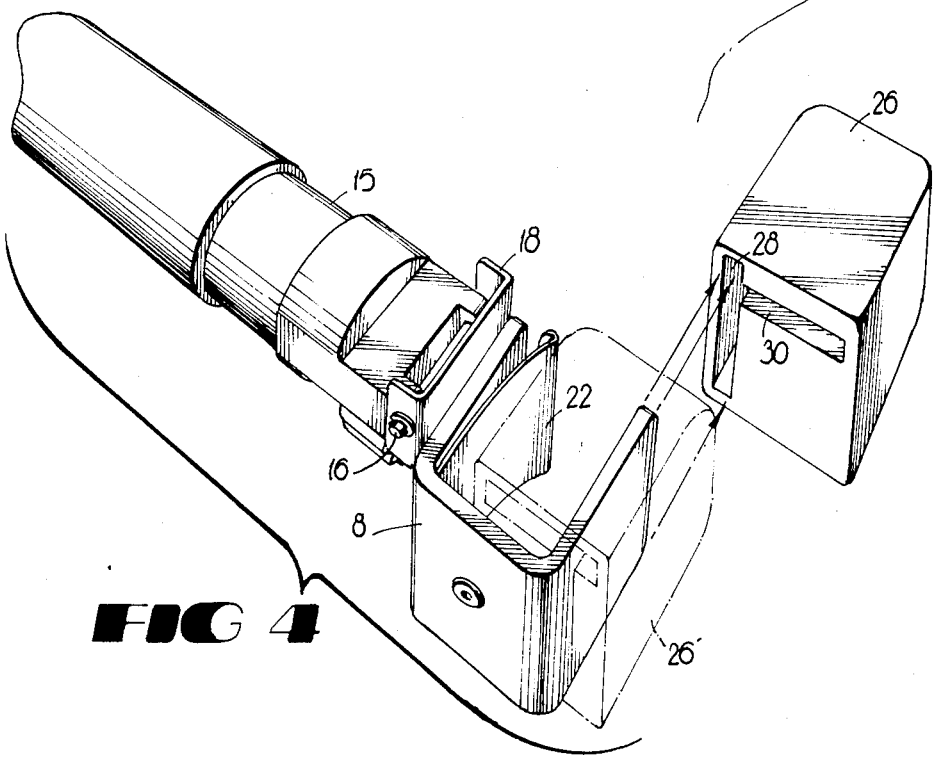
FIG. 4 is a fragmentary view of the ladder support member, showing the spacing member exploded away from the device, and showing as a phantom an alternative position for the spacing member.
Figure 5:
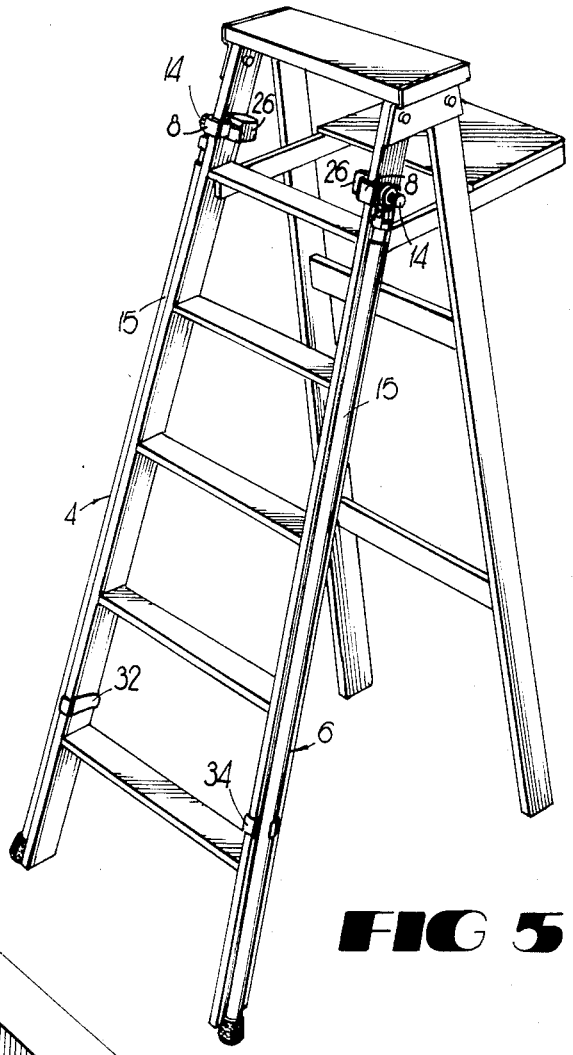
FIG. 5 is a perspective view of the stepladder as shown in FIG. 1, with the ancillary ladder support members folded away.

The spacing block 26 contains two or more slots 28,30. As shown in the preferred embodiment, the slots 28,30 are perpendicular to each other and each is relatively near one side of the block 26. One of the slots typically will, however, be further away from the side than the other, so as to provide increased dimensional selection. When the device is used with a ladder having a rectangular cross-section, the block 26 is placed on the U-shaped bracket 8 as shown in FIG. 3, so that most of the spacing block 26 is outside of the U-shaped bracket 8. When the device is to be used with a ladder which has a component made of channel to which the device is to be attached, the block 26 is removed as shown in FIG. 4, and turned as shown in the phantom view of FIG. 4 so that most of the spacing block 26 is inside the U-shaped bracket 8. Since each of the slots is a different distance from the edge of the spacing block, ladders having different dimensional cross-sections may be used, with the slot selected according to the ladder.

If desired, brackets 32,34 may be attached to the ladder so that the legs may be folded away. The U-shaped bracket 8 may either be clamped higher on the ladder so as to accomplish this folding, or the leg 15 could be a telescoping member, with telescoping provided by any commonly known means.

Figure 6:
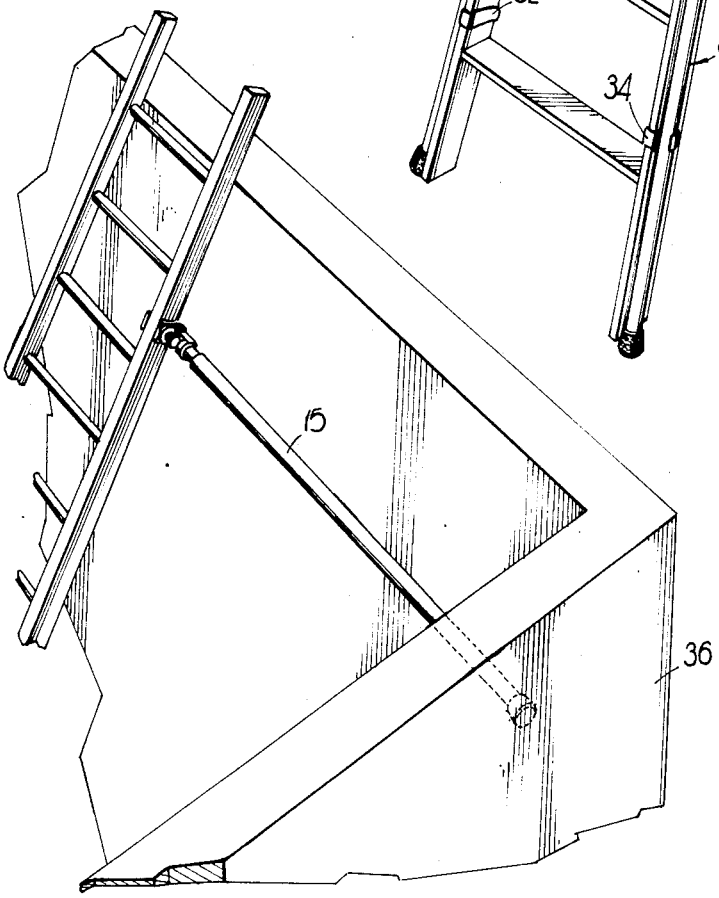
FIG. 6 is a fragmentary view showing an alternative mode of use of the ladder support member.

FIG. 6 shows an additional utility for the device, wherein the bottom of the leg contacts a wall 36, rather than the ground.

The present invention provides an ancillary ladder support which may be quickly and easily attached and removed from a ladder. It requires no tools for attachment, and due to the length of the leg and the easy engagement of the leg with the threaded member, is simple to use and may be used by almost anyone. The device is designed so that it may be used with virtually any type of ladder, and may be used whether the ladder is wooden or made of aluminum or other channel. It provides greatly increased stability for the ladder, whether due to the ladder being used on soft or unlevel ground, or due to structural deficiencies of the ladder itself. For those who are uncomfortable with being on ladders, it provides additional support which may be assuring, even when the ladder is used under ideal conditions.

What is claimed is:

1. A ladder support member, comprising:

a. a U-shaped bracket into which a portion of a ladder is inserted, and which has a threaded void on one side thereof;

b. a threaded member having a means thereon, and engaging said threaded void and said ladder so as to hold said ladder within said U-shaped bracket; and c. a leg member pivotally attached to said U-shaped bracket on said side having said threaded void therein, and having engaged means on an end near said point of pivotal attachment cooperating with said means on the threaded member upon pivoting of said leg member, whereby upon said engagement, rotation of said leg member rotates said threaded member.

2. A ladder support member as described in claim 1 further comprising a spacing block having slots therein into which a side of said U-shaped bracket is selectively inserted so as to rreduce an interior area of said U-shaped bracket.

3. A ladder support member as described in claim 1 wherein said threaded member engages a leaf attached to the interior of said U-shaped bracket and wherein said leaf is displaced toward said ladder by said threaded member so as to hold said ladder leg within said U-shaped bracket.

4. A ladder support member as described in claim 2 wherein said threaded member engages a leaf attached to the interior of said U-shaped bracket and wherein said leaf is displaced toward said ladder by said threaded member so as to hold said ladder leg within said U-shaped bracket.

5. A ladder support member as described in claim 1 wherein said engaging means is one or more gear teeth and wherein said means on the threaded member comprises a multiplicity of gear teeth which engage said gear teeth on said leg.

6. A ladder support member as described in claim 2 wherein said engaging means is one or more gear teeth and wherein said mean on the threaded member has a multiplicity of gear teeth which engage said gear teeth on said leg.

7. A ladder support member as described in claim 3, wherein said engaging means is one or more gear teeth and wherein said means on the threaded member has a multiplicity of gear teeth which engage said gear teeth on said leg.

8. A ladder support member as described in claim 4, wherein said engaging means is one or more gear teeth and wherein said means on the threaded member comprises a multiplicity of gear teeth which engage said gear teeth on said leg.

* * * * *